US006585027B1

(12) United States Patent
Roberts

(10) Patent No.: US 6,585,027 B1
(45) Date of Patent: Jul. 1, 2003

(54) ARCHED WINDOW SHADE SUPPORT DEVICE

(75) Inventor: Gary N. Roberts, Sarasota, FL (US)

(73) Assignee: Vista Products, Inc., Sarasota, FL (US)

( * ) Notice: Subject to any disclaimer, the term of this patent is extended or adjusted under 35 U.S.C. 154(b) by 0 days.

(21) Appl. No.: 10/034,172

(22) Filed: Dec. 19, 2001

(51) Int. Cl.[7] ..... A47H 5/00
(52) U.S. Cl. ..... 160/349.1; 160/84.07
(58) Field of Search ..... 160/84.07, 134, 160/327, 368.1, 349.1, 349.2, 382, 402, 84.05; 24/716

(56) References Cited

U.S. PATENT DOCUMENTS

| | | | | | |
|---|---|---|---|---|---|
| 1,528,910 | A | * | 3/1925 | Carlson | 160/349.1 |
| 2,092,156 | A | * | 9/1937 | Harper | 160/349.1 |
| 3,992,749 | A | | 11/1976 | Getchell | |
| 4,088,174 | A | * | 5/1978 | Edwards | 160/349.1 |
| 4,213,492 | A | | 7/1980 | Guebert et al. | |
| 4,237,958 | A | | 12/1980 | Guebert et al. | |
| 4,308,647 | A | | 1/1982 | Gillis | |
| 4,343,344 | A | * | 8/1982 | Shelton | 160/349.1 |
| 4,463,482 | A | | 8/1984 | Hawie | |
| 4,518,025 | A | | 5/1985 | Judkins | |
| 4,825,611 | A | | 5/1989 | Bassett | |
| 4,934,436 | A | | 6/1990 | Schnebly | |
| 5,044,418 | A | | 9/1991 | Donahue | |
| 5,141,045 | A | * | 8/1992 | Williams | 160/348 |
| 5,144,997 | A | * | 9/1992 | Marasco et al. | 160/349.2 |
| 5,168,912 | A | | 12/1992 | Jelic et al. | |
| 5,226,274 | A | | 7/1993 | Sommerstein | |
| 5,568,675 | A | | 10/1996 | Asami et al. | |
| 5,641,255 | A | | 6/1997 | Tanaka | |
| 5,678,704 | A | | 10/1997 | Deeds | |
| 5,706,878 | A | | 1/1998 | Guettler | |
| 5,718,549 | A | | 2/1998 | Noda et al. | |
| 5,765,619 | A | | 6/1998 | Arnold | |
| 6,231,089 | B1 | | 5/2001 | Decler et al. | |
| 6,298,526 | B1 | | 10/2001 | Baumdicker et al. | |

* cited by examiner

*Primary Examiner*—David Purol
(74) *Attorney, Agent, or Firm*—Charles J. Prescott

(57) ABSTRACT

An arched window multi-cellular or pleated fabric shade support device for holding the upper margin of the window shade in close proximity to the arch of the window. The device includes a base having orthogonally oriented upright and horizontal mounting surfaces each attachable to a side wall or a top surface of the arched window. The base also has an elongated cavity. A first clip member has an elongated support shaft extending in either direction from one end of a first support tab, a first end of said support shaft sized for releasable insertion into the cavity. A second clip member has a support tab and an aperture formed through one end thereof sized for releasable dependent attachment over a second end of the support shaft. The first and second support tabs are positioned in closely spaced relation one to another for supportive attachment with an upper margin of a fabric sheet or panel of the window shade.

5 Claims, 3 Drawing Sheets

ARCHED WINDOW

ARCHED WINDOW SHADE SUPPORT DEVICE

BACKGROUND OF THE INVENTION

1. Scope of Invention

This invention relates generally to window shade and window covering attaching means, and more particularly to a device for supporting the upper arcuate or geometric margin of a multi-cellular or pleated window shade which is adapted to substantially match the upper arcuate or geometric contour of a decorative window.

2. Prior Art

This invention is particularly adapted for the recently introduced multi-cellular and other somewhat self-supporting pleated window curtains and window shades and coverings. These types of window coverings not only provide uniform decorative light transfer therethrough depending upon the particular fabric chosen in construction, but also provide an insulation aspect for heat and cold transfer through the windows.

Decorative windows having either an arcuate or arched upper configuration or one of a geometric nature other than rectangular have also become quite popular in construction of buildings and homes. However, the window covering treatment technology has somewhat lagged behind the utilization of these decorative arch-type windows and it is still quite common to see the upper portion of an arched window be uncovered or open, while the lower rectangular portion of the arched window is covered and decoratively treated with a broad variety of conventional window coverings, including the multi-cellular curtain type.

A number of prior art devices have made an effort to deal with the window covering of these non-rectangular decorative arched window openings. In U.S. Pat. No. 4,934,436, Schnebly teaches a suspension and actuation system for such specialty window shades. However, the structure in the '436 patent is more directed to the opening and closure of multi-cellular window covering treatments and, as such, the bracketry associated with the upper margins of such window coverings are structurally and functionally different from that of the present invention.

Arnold, in U.S. Pat. No. 5,765,619 also teaches an arched window drape apparatus. However, this apparatus is directed to the support of generally flexible fabric drapery and the utilization of a support bow or arcuate shaped rigid support rod inserted along and adjacent to the upper margin of the drape arrangement.

Likewise, in U.S. Pat. No. 5,044,418 to Donahue and U.S. Pat. No. 5,678,704 to Deeds, a separate rigid arcuate member which supports the upper margin of a fabric drape arrangement is there taught. Again, all of these inventions which include the addition of a rigid arcuate support member for the upper margin of the drape material are substantially dissimilar from the present invention.

Applicant is aware of additional prior art apparatus and devices which are intended in some fashion to support a window covering and the flexible material utilized in their make-up as follows:

U.S. Pat. No. 4,518,025 to Judkins

U.S. Pat. No. 3,992,749 to Getchell

U.S. Pat. No. 4,825,611 to Bassett

U.S. Pat. No. 4,213,492 to Guebert, et al.

U.S. Pat. No. 4,237,958 to Guebert et al.

U.S. Pat. No. 4,308,647 to Gillis

U.S. Pat. No. 4,463,482 to Hawie

U.S. Pat. No. 6,298,526 to Baumdicker et al.

U.S. Pat. No. 5,706,878 to Guettler

U.S. Pat. No. 5,168,912 to Jelic et al.

U.S. Pat. No. 5,568,675 to Asami et al.

U.S. Pat. No. 5,641,255 to Tanaka

U.S. Pat. No. 5,718,549 to Noda et al.

U.S. Pat. No. 6,231,089 to DeCler et al.

U.S. Pat. No. 5,226,274 to Sommerstein

The present invention teaches a very simplistic three-part attachment arrangement which is releasably interengagable with the upper arcuate or geometric margin of a multicellular window covering or any pleated window covering wherein the fabric utilized to form the window covering has a substantial ability to support itself in a deployed or installed configuration with the aid of the present invention. With such semi-rigid or selfsupporting window coverings, the invention will establish and maintain the upper arcuate or geometric margin in a desired close proximity to the arcuate or geometric configuration of the upper portion of such decorative windows.

BRIEF SUMMARY OF THE INVENTION

This invention is directed to an arched window multi-cellular or pleated fabric shade support device for holding the upper margin of the window shade in close proximity to the arch of the window. The device includes a base having orthogonally oriented upright and horizontal mounting surfaces each attachable to a side wall or a top surface of the arched window. The base also has an elongated cavity. A first clip member has an elongated support shaft extending in either direction from one end of a first support tab, a first end of said support shaft sized for releasable insertion into the cavity. A second clip member has a support tab and an aperture formed through one end thereof sized for releasable dependent attachment over a second end of the support shaft. The first and second support tabs are positioned in closely spaced relation one to another for supportive attachment with an upper margin of a fabric sheet or panel of the window shade.

It is therefore an object of this invention to provide a support device for arched or geometric window multi-cellular or pleated fabric window shades or coverings without the need for additional support structure for the upper margin of such window shades and coverings.

It is another object of this invention to provide an easily adjustable, economical support device which is quickly attachable to the inner arch surface or window frame surface of an arched window to support the upper mating margin of a multi-cellular or pleated window covering and which provides easy attachment and detachment and limited adjustability to facilitate pleat spacing and close alignment with the upper margin of the multi-cellular or fabric to the arched shape of the decorative window.

In accordance with these and other objects which will become apparent hereinafter, the instant invention will now be described with reference to the accompanying drawings.

DETAILED DESCRIPTION OF THE INVENTION

Figure 1:
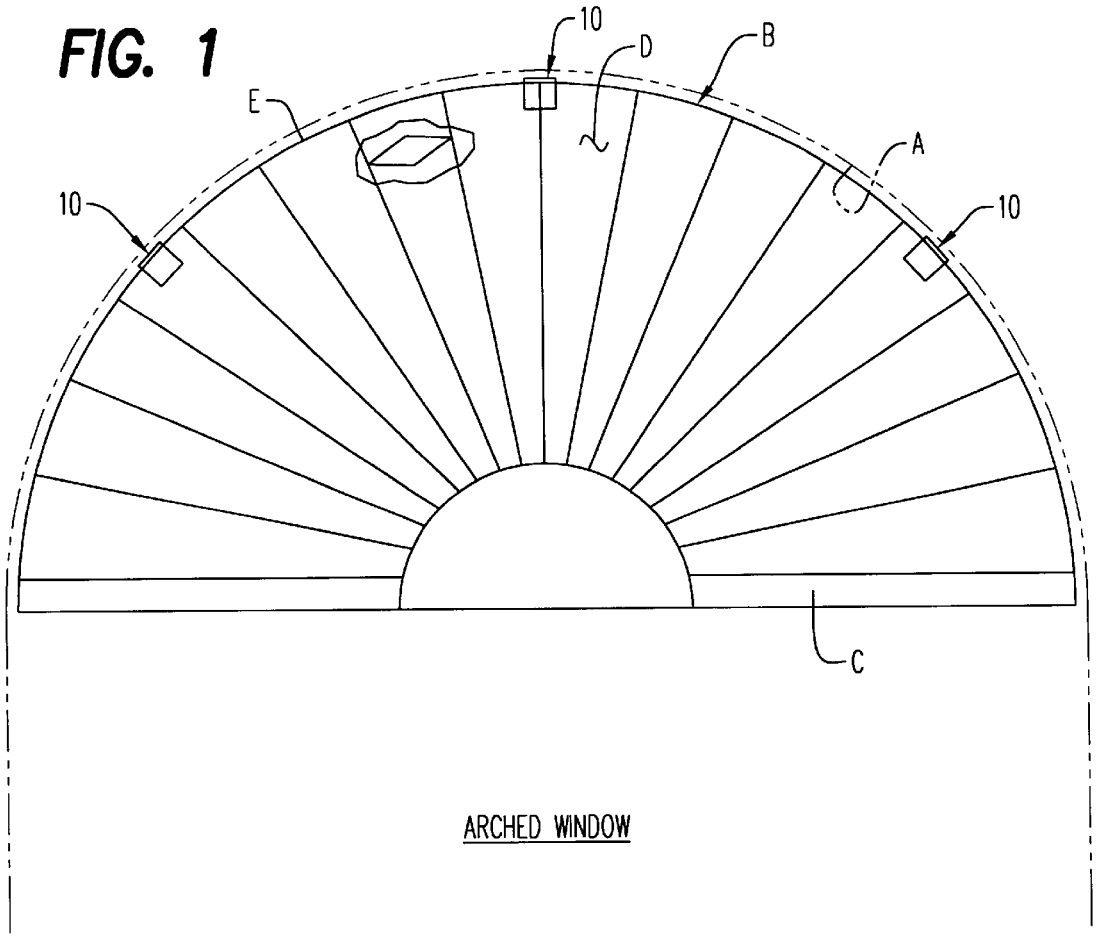
FIG. 1 is a front elevation partially broken schematic view of the invention deployed to support the upper margin of an arched window multi-cellular shade or window covering.

Referring now to the drawings, the invention is generally shown at numeral 10 and is deployed in three locations shown in FIG. 1 equally spaced about the arcuate inner surface A of an arched window, the lower portion of the window (not shown) being rectangular and conventional. The arched window covering is shown generally at B and includes a rigid horizontal bar C which is attached or anchored to the sides of the window in conventional fashion. The window covering B is constructed of individual fabric cells D formed of spaced fabric cells which are generally of sufficient structural integrity to be somewhat self-supporting in the open deployed configuration shown in FIG. 1. However, over time, the weight of this multi-cellular construction will sag and the clearance gap between the window arch A and the upper margin E of the window covering B will increase and become irregular. As shown in FIG. 1, it is preferred that at least three of the devices 10 be deployed at 450 one to another as shown for sufficient support and economy.

Figure 2:
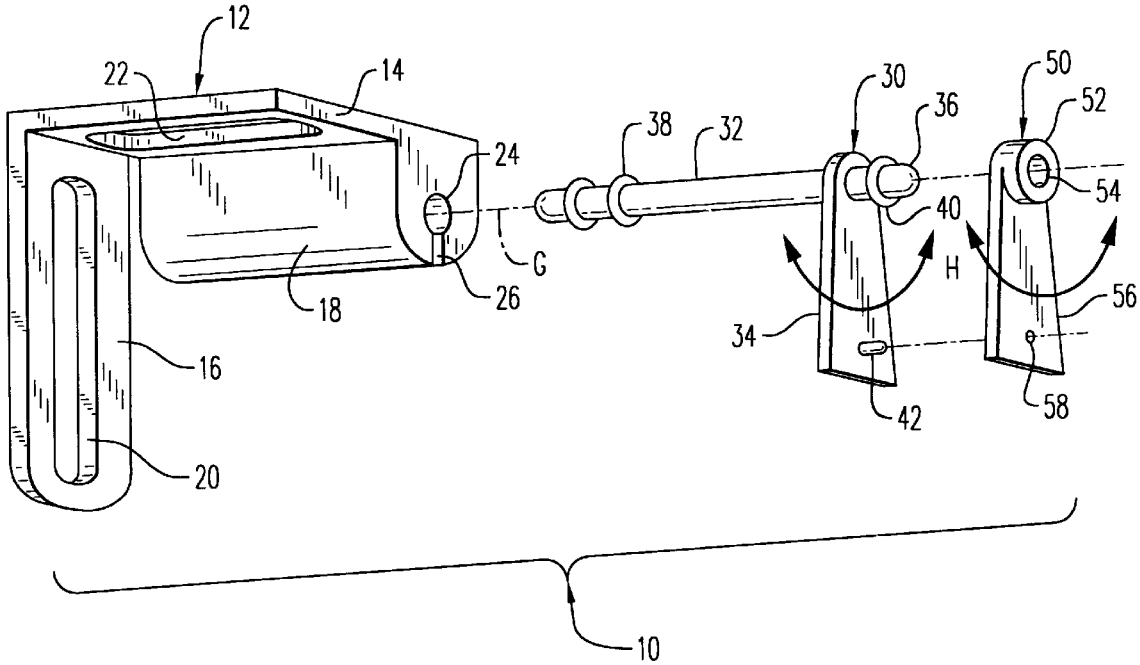
FIG. 2 is an exploded perspective view of the invention.
Figure 3:
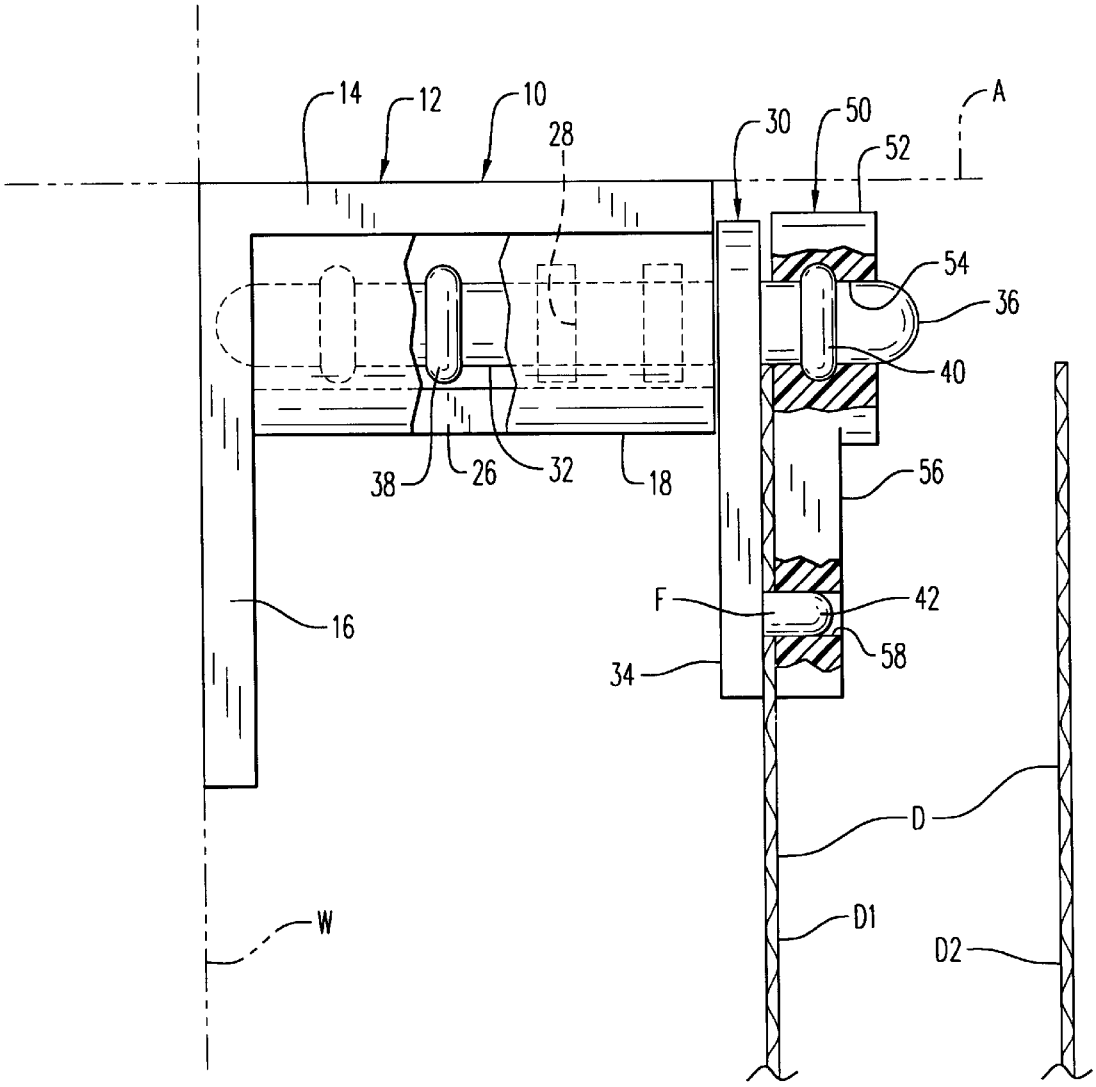
FIG. 3 is a side elevation partial section view of the invention assembled and in use supporting a multi-cellular window covering.

Referring to FIG. 2, the device 10 includes a base 12, a first clip 30, and a second clip 50, all of transparent molded plastic The base 12 includes a flat horizontal mounting surface 14 and a vertical mounting surface 16. As seen in FIG. 3, the horizontal mounting surface 14 is attachable to the arcuate window surface A through elongated aperture 22 by mechanical fastening means. Alternately, the vertical mounting surface 16 may be attached to the window frame W through an elongated slot 20 also by mechanical fastening means. By this arrangement, a considerable amount of latitude is provided in selecting the vertical and horizontal spacing of the attaching point of each of the bases 12. The base 12 also includes an elongated cavity 24 which extends along base portion 18. This cavity 24 is parallel to and spaced just beneath the plane of the horizontal mounting surface 14.

An elongated slot 26 extending along the entire base portion 18 at the lower portion of cavity 24 provides resiliency for the releasable retention of an elongated support shaft 32 of the first clip member 30. Clip member 30 includes a flat support tab 34 formed as a unit with the support shaft 32 which is disposed orthogonally at and with respect to the upper end of the support tab 34.

The support shaft 32 includes two spaced enlarged detents 38 which, as best seen in FIG. 3, snapingly engage into inside cavities 28 to provide for spatial adjustment of the clip 30 and support tab 34 longitudinally with respect to the support shaft 32 within cavity 24. Again, slot 26 adds resilient expansion of cavity 24 as the detents move into the cavity. This provides horizontal adjustability of the upper margin E of the window covering B by simply moving the first clip member 30 axially on support shaft 32 to any desired detent position of the detents 30*a* within cavities 28.

The second clip member 50 includes its own support tab 56 and an aperture 54 formed perpendicularly to the support tab 56 at the enlarged end 52. Aperture 54, as best seen in FIG. 3, snapingly engages over and is releasably retained onto the smaller support shaft extension 36. Again, an enlarged detent 40 mating within a cavity formed within enlarged end 52 (not shown) as previously described, serves to hold the second clip 50 in position on support shaft extension 36.

INSTALLATION

A benefit of the present invention is that the base 12 may be initially installed to the structure of the arched window via either the horizontal or the vertical mounting surface 14 or 16 or both. Thereafter, the lower rigid bar C of the window covering B may be attached by its own brackets and, thereafter, the multi-cellular fabric D may be attached to the device 10 as will now be described.

The support shaft 32 is initially inserted into cavity 24 and an additional longitudinal placement is established. Thereafter the inner panel D1 of the multi-cellular fabric D is pierced through by pin 42 at F in FIG. 3. This pin 42 is attached to and orthogonally extends from the upright support tab 34. Thereafter, the second clip 50 is slidably engaged over shaft 36 into its releasably locked engagement via enlarged detent 40 as previously described. Simultaneously a hole 58 formed through the support tab 56 engages over the exposed portion of pin 42 to squeeze and retain fabric panel D1 between facing surfaces of the two support tabs 34 and 56.

Once the installation arrangement is completed as shown in FIG. 3, minor variations and adjustment may be effected in simple fashion. Lateral or in and out horizontal movement of the upper margin E may be effected either by moving the support shaft 32 in and out with respect to cavity 24 as previously described. Likewise, the slots 20 and 22 provide for both small variations of vertical and horizontal movement with respect to the attaching fastener, again as previously described. Lastly, arcuate movement of the support tabs 34 and 56 which now move in unison as a result of the interengagment of pin 42 and aperture 58, will move the individual pleats both laterally and vertically so as to accomplish a uniform desired spacing between the outer margin E and the inner window margin A, as well as establishing a uniform size of the individual pleats between each of the clips 10.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An arched window multi-cellular or pleated fabric shade support device comprising:

a base formed as a unit having orthogonally oriented upright and horizontal mounting surfaces each adapted for receiving a mounting screw for attachment of said base to a side wall or a top arcuately-shaped surface of an arched window;

said base having an elongated cavity oriented generally parallel to said horizontal mounting surface;

a first clip member having an elongated support shaft and a first support tab, said support shaft extending in either direction from one end of said first support tab, one end of said support shaft sized for releasable dependent retention within said cavity;

a second clip member having a second support tab and an aperture formed through one end thereof sized for releasable dependent attachment over another end of said support shaft;

said first and second support tabs being positioned in closely spaced relation one to another when said one end of said support shaft is inserted into said cavity and said aperture of said second clip is attached over the other end of said support shaft, facing surfaces of said first and second clips having cooperative structure for supportive attachment to either side of an upper margin of a fabric sheet or panel which forms at least a portion of a multi-cellular or pleated window shade, the upper margin substantially mating with, and held in close proximity to, the arcuate contour of the arched window between said first and second clips when said base is attached to either the side wall or the top arcuately shaped surface of the arched window.

2. An arched window multi-cellular or pleated fabric shade support device as set forth in claim 1, wherein:

said support shaft and said cavity are cooperatively structured for free relative rotation and incremental engagement therebetween whereby said first tab is selectively positionable with respect to said base;

said first and second tabs are freely rotatable about an axis of said shaft.

3. For an arched window multi-cellular or pleated fabric shade formed of fabric sheet or panel material and being of the type having an arcuate or geometric upper edge which substantially matches an arcuate or geometric shape of the upper surface of a decorative window, a support device comprising:

a base having orthogonally oriented upright and horizontal mounting surfaces each adapted for attachment of said base to a side wall or a top arcuately-shaped surface of the decorative window, said base having an elongated cavity oriented generally parallel to said horizontal mounting surface;

a first clip member having an elongated support shaft and a first support tab, said support shaft extending orthogonally in either direction from one end of said first support tab, one end of said support shaft sized for releasable insertion into said cavity;

a second clip member having a second support tab and an aperture formed through one end thereof sized for releasable dependent attachment over another end of said support shaft;

said first and second support tabs being positioned in closely spaced facing relation one to another when said one end of said support shaft is inserted into said cavity and said aperture of said second clip is attached over the other end of said support shaft;

facing surfaces of said first and second clips cooperatively structured for supportive retaining attachment against either side of, and adjacent the fabric upper margin which forms at least a portion of a multi-cellular or pleated window shade, the upper margin substantially mating with, and held vertically in close proximity to, the arcuate or geometric contour of the arched window between said first and second clips when said base is attached to either the side wall or the top arcuately shaped surface of the arched window.

4. An arched window multi-cellular or pleated fabric shade support device as set forth in claim 3, wherein:

said support shaft and said cavity are cooperatively structured for free relative rotation and incremental engagement therebetween whereby said first tab is selectively positionable with respect to said base;

said first and second tabs are freely rotatable about an axis of said shaft.

5. A support device for supporting an upper margin of a fabric sheet or panel forming an arched window multi-cellular or pleated fabric shade, said support device comprising:

a molded plastic base formed as a unit having orthogonally oriented upright and horizontal mounting surfaces each of which is slotted for receiving a fastener therethrough for attachment of said base to a side wall or a top arcuately-shaped surface of an arched window;

said base having an elongated cavity oriented generally parallel to said horizontal mounting surface;

a molded plastic first clip member having an elongated support shaft and a first support tab, said support shaft extending in either direction from one end of said first support tab, one end of said support shaft sized for releasable dependent retention and held within said cavity for rotation only;

a molded plastic second clip member having a second support tab and an aperture formed through one end thereof sized for releasable dependent attachment over another end of said support shaft;

said first and second support tabs being positionable in closely spaced relation one to another when said one end of said support shaft is inserted into said cavity and said aperture of said second clip is attached over the other end of said support shaft;

facing surfaces of said first and second clips having a cooperative pin and mating aperture structure for piercing supportive attachment through the fabric sheet or panel and against either side thereof, the upper margin substantially mating with, and held in close proximity to, the arcuate contour of the arched window between said first and second clips when said base is attached to either the side wall or the top arcuately shaped surface of the arched window.

* * * * *